US005584580A

United States Patent [19]

Vetter

[11] Patent Number: 5,584,580

[45] Date of Patent: Dec. 17, 1996

[54] TAMPER-RESISTANT ENVELOPE CLOSURE

[75] Inventor: Kurt W. Vetter, Long Island, N.Y.

[73] Assignee: Uniflex, Inc., Westbury, N.Y.

[21] Appl. No.: 201,125

[22] Filed: Feb. 24, 1994

[51] Int. Cl.[6] ..... B65D 33/34

[52] U.S. Cl. ..... 383/5; 383/84; 383/93

[58] Field of Search ..... 383/5, 93, 84, 383/94

[56] References Cited

U.S. PATENT DOCUMENTS

| | | | |
|---|---|---|---|
| 3,510,053 | 5/1970 | Focke | 383/93 X |
| 4,235,653 | 11/1980 | Ausnit . | |
| 4,247,563 | 1/1981 | Sample . | |
| 4,464,158 | 8/1984 | Kardon . | |
| 4,483,018 | 11/1984 | Whelan . | |
| 4,601,694 | 7/1986 | Ausnit . | |
| 4,708,705 | 11/1987 | Aubry . | |
| 4,709,397 | 11/1987 | Voshall et al. | 383/5 |
| 4,834,552 | 5/1989 | Makowka . | |
| 4,932,791 | 6/1990 | Vetter | 383/93 |
| 4,937,040 | 6/1990 | Holcomb . | |
| 4,988,547 | 1/1991 | Voto, Jr. et al. | 383/5 |
| 4,998,666 | 3/1991 | Ewan . | |
| 5,045,040 | 9/1991 | Vetter . | |
| 5,077,001 | 12/1991 | Makowka . | |
| 5,108,194 | 4/1992 | Raden . | |
| 5,219,194 | 6/1993 | Trent . | |
| 5,294,470 | 3/1994 | Ewan . | |
| 5,318,364 | 6/1994 | Raden . | |
| 5,346,301 | 9/1994 | Scarberry . | |
| 5,352,041 | 10/1994 | Fullerton . | |
| 5,405,197 | 4/1995 | Makowka . | |
| 5,407,277 | 4/1995 | Burke . | |
| 5,425,825 | 6/1995 | Rasko . | |

*Primary Examiner*—Jes F. Pascua

*Attorney, Agent, or Firm*—Dilworth & Barrese

[57] ABSTRACT

A tamper-resistance envelope formed of a thermoplastic resin comprises two opposing panels having respective bottom and side wall edges bonded together to form a pocket therebetween. The top of the pocket is open for inserting an item into the pocket. Each panel has an edge portion adjacent the opening. A bead of pressure-sensitive adhesive is applied along each of the edge portions, and the adhesive bead is heat-seal bonded to the thermoplastic edge portion. The edge portions are brought together to bring the adhesive beads into contact to close the opening. By heat-seal bonding the adhesive beads directly to the thermoplastic edge portions, the pressure sensitive adhesive is resistant to being open by supercooling.

7 Claims, 1 Drawing Sheet

TAMPER-RESISTANT ENVELOPE CLOSURE

BACKGROUND OF THE INVENTION

This invention relates to tamper-resistant closable bags and envelopes and, more particularly, it concerns an improved closure sealing arrangement for envelopes of the type in which a band of pressure sensitive adhesive, initially covered by a releasable liner strip, is effective to seal opposing panel surfaces at the opening through which the envelope is filled.

Envelopes formed from pliable thermoplastic sheet materials have become increasingly popular for use by courier service organizations to package documents and other items to be shipped, usually on an expedited basis. Such envelopes are especially suited to this use because of the relatively high strength of the plastic sheet material, resistance to damage by water and other liquids, imperviousness to moisture generally and because of the ability of the sheet material to be printed in a wide range of distinguishing colors and styles. Additionally, the plastic sheet materials of such envelopes are receptive to a variety of pressure-sensitive adhesives by which a strong and secure sealed closure of the envelope may be effected after it is filled.

Although various thermoplastic envelopes and sealing methods are known, U.S. Pat. Nos. 5,045,040 and 4,932,791 disclose an especially useful envelope closure seal and method for envelopes having front and back panels joined along bottom and side edges and in which a release liner strip delimits overlying marginal edges along the top of the panels. The liner strip initially covers a pressure sensitive adhesive band in the top marginal edge of one of the panels and extends through the side edge junctures of the panels to enable removal of the liner strip and securement of the top margins by the pressure sensitive adhesive band. Registered lines of perforations are formed across the top portion of both panels below the bottom edge of the release liner strip to define a tear line for opening the envelope after it has been sealed in embodiments not intended for liquid contents. In envelopes which must be completely sealed, e.g., envelopes for containing a liquid, the lines of perforations are omitted and the adhesive band joins with fused side edges of the envelope.

Hot-melt, pressure-sensitive adhesives having an aggressive bond to the envelope material are typically used to effect closure of envelopes which are required to afford security to the package once it is sealed. A band, or bead, of an adhesive is usually applied in a molten state directly on the thermoplastic sheet material and then covered with a removable silicone-treated release liner that is removed at the time of use.

A problem that exists with present closure systems, however, is that when the closure is subjected to very low temperatures, e.g., by applying dry ice or spraying the closure with liquid nitrogen, Freon or another similar fluorocarbon or chlorofluorocarbon or other gas used for flash coolants, the closure can, for a brief time, be opened without any evidence of tampering and re-closed when ambient temperature is again reached, at which time the envelope returns to its original sealed condition. This is due to the fact that at extremely low temperatures adhesives of this type lose the ability to retain a bond to the material to which they have been adhered.

Attempts have been made to thwart such tampering and eliminate the violation of security packaging by the use of tamper-evident sealing systems for plastic envelopes. One such system is described in U.S. Pat. No. 5,077,001, which discloses the use of a tamper-evident sealing means having a pattern of regions having visibly distinct reflective characteristics and which provides visible evidence of any attempt to open and reseal the package. This patent discloses that such a tamper-evident system is needed because, due to the non-porous nature of plastics such as polyolefins, the adhesive does not penetrate into the plastic and only adheres to its outer surface, such that upon application of high or low temperatures the adhesion (between the adhesive and the plastic) dissipates or releases the bond as it temporarily recrystallizes, permitting the flap to be opened and then re-sealed as the adhesive regains its properties when it returns to normal temperatures.

SUMMARY OF THE INVENTION

Notwithstanding numerous attempts by workers in the industry to find a simple and inexpensive way of overcoming the violation of security packaging, in accordance with the present invention, it has been discovered that thermoplastic envelopes sealed with a hot-melt, pressure-sensitive adhesive can be rendered less susceptible to being opened by super-cooling, e.g., using a flash-coolant as described above, by "heat-seal bonding" a bead of hot-melt, pressure-sensitive adhesive to each of the panels of the envelopes which are to be sealed together. As used herein, the term "heat-seal bonding" refers to the fusing of the hot-melt adhesive to the polyolefin, or other thermoplastic sheet, forming the envelope by the application of heat sufficient to fuse the adhesive and the sheet material, as opposed to merely applying the adhesive in a molten state on the surface of the thermoplastic-material.

An object of the present invention is a tamper-resistant closure system for plastic envelopes and method for producing the same wherein materials and equipment generally known for in the manufacture of plastic courier envelopes may be employed rendering it unnecessary to use special materials for the sealing system.

Yet another object of the present invention is a strong and durable closure system for plastic courier envelopes which renders a sealed envelope less susceptible to being opened and re-sealed without destruction of the envelope.

The foregoing and other objects and advantages of the present invention which may become apparent for the following description thereof and from the practice of the invention may be achieved by a tamper-resistant closure system for an envelope having two opposing panels which form a pocket therebetween and having an opening for inserting an item into the pocket, each of the panels having an edge portion adjacent the opening and formed of a thermoplastic resin, which system comprises two beads of a pressure-sensitive adhesive each extending along the opening and positioned on its corresponding edge portion so as to contact the opposing bead when the edge portions are brought together, the adhesive of each bead being heat-seal bonded to the thermoplastic of the edge portion of a corresponding one of the panels and the beads being self-bonding to one another when brought into contact with one another.

In accordance with another aspect of the present invention there is provided a method of forming a closure for an envelope having two opposing panels which form a pocket therebetween and having an opening for inserting an item into the pocket, each of the panels having an edge portion adjacent the opening formed of a thermoplastic resin, which method comprises applying a bead of a pressure-sensitive adhesive to each of the edge portions at a location so that the beads of adhesive contact each other when the edge portions are brought together, and applying heat to the adhesive of each of the beads and the thermoplastic resin of the corresponding edge portion to heat-seal bond the bead to the thermoplastic resin.

The present invention will be more fully understood by reference to the following description of preferred embodiments thereof read in conjunction with the accompanying drawings in which like parts are designated by like reference characters.

DESCRIPTION OF PREFERRED EMBODIMENTS

Various types of well-known plastic envelopes may be used in the present invention. For example, such envelopes may be of a single-wall construction or multi-wall construction, may contain one or more pockets into which one or more items can be inserted, and may be watertight, airtight or vented. The envelopes are formed of a sheet or film of a suitable thermoplastic resin, such as a polyethylene, polypropylene or other polyolefin of the desired gauge and physical properties. Methods and materials for use in making such envelopes are well-known, and are disclosed, for example, in commonly owned U.S. Pat. No. 5,045,040, which is incorporated herein by reference.

The present invention will be described herein with reference to a single-wall, single-pocket envelope made of polyethylene or polypropylene; however, many of a large number of envelope types may be used in the practice of the invention.

Figure 1:
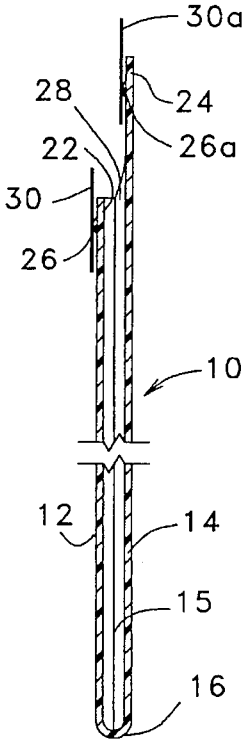
FIG. 1 depicts a side view of an envelope in accordance with a first embodiment of the present invention prior to being sealed.
Figure 2:
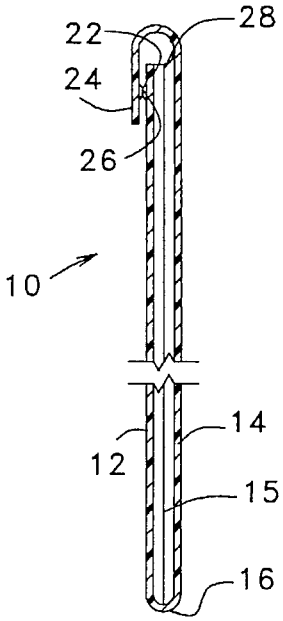
FIG. 2 is illustrative of the envelope of FIG. 1 after being sealed.

In FIGS. 1 and 2 of the drawings depicting a first embodiment of this invention, an envelope incorporating the closure arrangement of the present invention is generally designated by the reference numeral 10 and shown to include opposing, coextensive front and back or otherwise overlying panels 12 and 14, respectively. The envelope is made from a web of a thermoplastic resin such as polyethylene, with panels 12 and 14 being joined at the bottom of the envelope 10 by a linear fold 16 and fused at their side edges, the interior of one such side edge being designated by the reference numeral 15 in FIGS. 1 and 2. The top edge portions of the panels 12 and 14, designated by the reference numerals 22 and 24, respectively, extend for the full width of the envelope and are initially unsecured along the full length thereof to provide a top opening 28 for access to the interior of the envelope. In this respect, it will be noted also that the back panel 14 of the envelope 10 shown in FIG. 1 is slightly longer than the front panel 12 so that the top edge portion 24 of the back panel 14 extends slightly beyond the top edge portion 22 of the front panel 12 so as to form a flap which can be folded down and across the opening 28 when the envelope is closed.

In FIG. 1, a continuous band, or bead, of pressure-sensitive adhesive 26 extends along the outside of edge portion 22 of front panel 12 adjacent the opening 28 of the envelope. A similar bead of pressure-sensitive adhesive **26*a* extends along the inside of edge portion 24 of back panel 14 adjacent opening 28. A releasable linear strip 30 is positioned on bead 26, and, similarly, a releasable linear strip 30*a* covers bead 26*a*. Releasable liner strips 30 and 30*a* are used to initially prevent the pressure sensitive adhesive of beads 26 and 26*a*, respectively, from contacting and seizing the opposing panel of the envelope or other objects being inserted through the opening 28 into the envelope. When it is desired to seal the envelope, releasable liners 30 and 30*a* are peeled from their corresponding panels 12 and 14, respectively. The top edge portion 24 of back panel 14 is then pulled down and across the opening 28, and bead 26*a* is brought into contact with bead 26, under pressure if desired. The pressure-sensitive adhesive beads 26 and 26*a* are self-bonding and when these are brought into contact with one another they become permanently bonded to one another to form a unitary seal 32, as shown in FIG. 2**.

Figure 3:
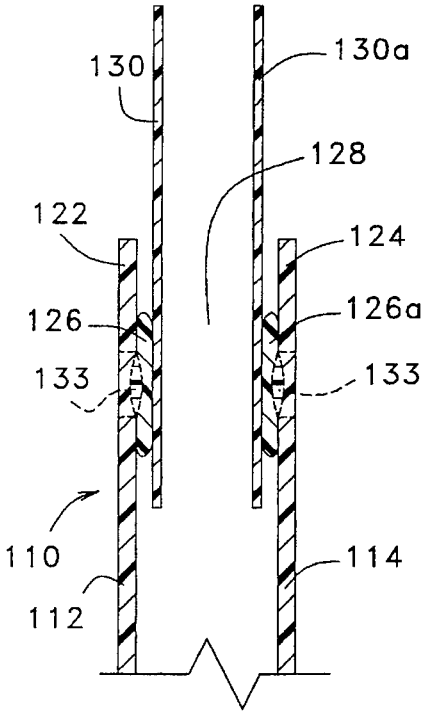
FIG. 3 illustrates a partial side view of an envelope in accordance with a second embodiment of the present invention prior to being sealed.
Figure 4:
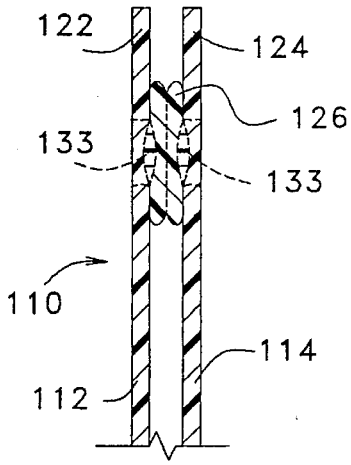
FIG. 4 illustrates the envelope of FIG. 3 after being sealed.

A second embodiment of the present invention is shown in FIGS. 3 and 4, which show only the portion of an envelope adjacent the opening through which an item is inserted into the pocket of the envelope and are enlarged relative to FIGS. 1 and 2 to better illustrate the heat-seal bonding of the pressure-sensitive adhesive to the front and back panels of a thermoplastic envelope. FIGS. 3 and 4 use a 100-series of the same numerals to designate corresponding parts of the envelope shown in FIGS. 1 and 2.

As described above, envelope 110 is formed of opposing front and back panels, 112 and 114, respectively, of polyethylene or another suitable thermoplastic resin. Top edge portion 122 and 124 extend upwardly approximately the same distance along the height of the envelope and are adjacent opening 128 formed between them. Beads of hot-melt, pressure-sensitive adhesive 126 and **126*a* are heat-seal bonded on the inside of top edge portions 122 and 124, respectively, and releasable liner strips 130 and 130*a* are positioned on adhesive beads 126 and 126*a*, respectively, and serve as a means to protect the adhesive and prevent premature seizure of another object by the pressure-sensitive adhesive. Typically, the adhesive beads 126 and 126*a* and the releasable liner strips 130 and 130*a* extend laterally along the full width of top edge portions 122 and 124. Strips 130 and 130*a*** cover their corresponding adhesive beads, extending downwardly at least a small distance past the adhesive and extending upwardly and out of the envelope for a distance sufficient to provide a hand-hold which permits the user of the envelope to grasp each strip and peel it from the adhesive when the envelope is to be closed and sealed.

Release liner strips 30, **30*a*, and 130, 130*a* are formed of a material which adheres to the pressure-sensitive adhesive used to form beads 26, 26*a*, and 126, 126*a***, respectively, but which is readily releasable therefrom when pulled by a hand of the user of an envelope. Such release liner strips are well known in the art of making sealable plastic envelopes. A preferred release lines strip is formed of high density polyethylene coated with silicone on one surface to enable its release from the pressure-sensitive adhesive bead on which it is placed. Alternatively, a silicone-coated strip of a suitable paper may be used for the releasable liner strips.

Adhesive beads 26, **26*a* and 126, 126*a*** are formed of a pressure-sensitive adhesive which is self-bonding to itself and which can be heat-seal bonded to the thermoplastic resin of an envelope. It is preferred to use a commercially available permanent grade hot-melt, pressure-sensitive adhesive, which typically is comprised principally of a polymer system, one or more tackifiers and one or plasticizers, as is well-known in the adhesive art, plus various modifiers.

The polymer system typically in a styrenic block copolymer having a molecular weight of from 75,000 to 150,000 and in which the end part of the block structure is styrene and the soft mid-part of the block structure is isoprene, ethylene-butadiene or butadiene. The tackifiers used typically have a molecular weight of from 500 to 2,000, and may be derived from the petroleum, citrus or wood industry. The plasticizer portion of the adhesive system are usually naphthenic hydrocarbons having a molecular weight of from 500–1,000. Such adhesive systems are well-known, and the choice of the adhesive for use in the present invention will be in large part governed by the desired level of tackiness, melt viscosity, heat resistance and adhesive strength. An especially suitable permanent grade, hot-melt, pressure-sensitive adhesive useful in the practice of the present invention is "HL-2201-X", manufactured by H. B. Fuller of Edison, N.J., although other suitable adhesives of the above type may be used, provided they can be heat-seal bonded to the thermoplastic material used in the envelope.

In accordance with the present invention, each of the adhesive beads 26, 26*a* and 126, 126*a* is formed by coating a band of a suitable permanent grade, hot-melt, pressure sensitive adhesive in a molten state on a surface of a web of a thermoplastic material, preferably a polyolefin such as polythylene or polypropylene, having a suitable thickness providing the strength and other characteristics desired in the envelope. If polythylene or polypropylene is used, the thickness of the web is typically from about 2 to about 5 mils. Each band of adhesive is applied on an edge portion of the envelope adjacent the envelope opening so that when the envelope is formed the band will be spaced from, but generally parallel to, the edge of the opening and extend across the width of the envelope, preferably completely if the envelope is to be completely sealed. The band of the adhesive laid down may be of any suitable width providing the desired alignment with the adhesive bead on the edge portion of the opposing panel of the envelope and affording enough land to achieve a successful heat seal to the thermoplastic of the envelope. Typically, the width of the adhesive band is from about ¼" to about ¾". Methods and apparatus for forming the adhesive beads are well-known in the art and need not be described herein.

Upon being coated on the surface of the thermoplastic material, the adhesive hardens and adheres to the thermoplastic surface, while retaining the desired level of tackiness. At this stage the adhesive adheres only to the surface of the thermoplastic material and its adhesion to the thermoplastic material can be dissipated, i.e, it can readily be separated from the envelope material, by cooling to a very low temperature, e.g., by the application of dry ice or a flash coolant. Therefore, in order to permanently bond the adhesive to the thermoplastic material, i.e., to eliminate the susceptibility to such separation thermoplastic material it is necessary to heat each of the adhesive bands, or beads, and the underlying thermoplastic material of the envelope to a temperature sufficient to effect a heat sealed bond between the adhesive and the thermoplastic resin sheet, similar to the bond which results when two sheets of thermoplastic resin are joined by the application of heat to fuse the two pieces of plastic and achieve a permanent plastic-to-plastic bond.

The above-mentioned heat sealed bonding of the hot melt, pressure-sensitive adhesive to the thermoplastic envelope material may be accomplished by heating the adhesive and underlying thermoplastic resin to a temperature and for a time sufficient to cause a fusion of the adhesive and the resin, while maintaining the desired characteristics of each of the materials fused together.

In commercial practice, the above heat sealed bonding may be performed by first placing on the adhesive a strip of releasable liner material, e.g., a polyethylene strip silicon-coated on the side in contact with the adhesive. This liner strip usually has a width somewhat greater than the width of the band of adhesive and covers the band of adhesive coated on the thermoplastic material. Then, the adhesive is heat sealed bonded to the envelope material by the application of heat, or heat and pressure. For example, a conventional heated sealing jaw or a heated roller may be used to apply heat and pressure on the liner strip so as to fuse the adhesive and the thermoplastic sheet. Advantageously, however, the heat sealed bonding may be performed by passing the areas to be so-bonded under one or more streams of heated air so as to achieve the desired temperature and dwell time. Typically, one or more jets of air heated to about 450° F. may be used for this purpose. Such heating with air eliminates the need for physical contact with a mechanical device, which tends to cause the adhesive to be extended from its desired position on the thermoplastic sheet.

As shown in FIGS. 3 and 4, the heat sealed bonding results in a fused area 133 underlying all or a portion of each of the bands of adhesive 126, 126*a* so that the adhesive is permanently bonded to the thermoplastic resin. The term "permanently bonded", as used herein, means that the adhesive cannot be separated from the envelope material without destruction of the envelope so that after a violation of the integrity of a sealed envelope there remains evidence of such violation.

The closures of a quantity of polyethylene envelopes made in accordance with the present invention and sealed with a hot-melt adhesive (marketed by National Starch and Chemical Corporation, New York, N.Y., under the registered trademark "DURO-TAK"). The molten adhesive was applied as a ½" band along the edge portions of each of opposing panels of each envelope and a silicone-coated polyethylene releasable liner strip was placed over each adhesive band. A jet of air heated to 450° F. was directed onto the liner strip for 0.250 seconds to heat seal band the adhesive to the polyethylene. Then the releasable liner strip was peeled off each of the adhesive beads, each envelope was closed and sealed, and then subjected to flash freezing by use of a Component Cooler sold by Radio Shack under the brand name "Realistic" to the point where the closures become covered with frost and brittle. In such condition, the closures could not be opened without severing the polyethylene, thus rendering the envelopes both tamper evident and useless, due to the fact that they could not be re-closed as the envelope itself was destroyed.

In contrast to the above-described envelope closures made in accordance with the present invention, similar closures made without heat seal bonding the hot-melt adhesive to the polyethylene were tested as described above. After the flash cooling the adhesive was readily separable from the polyethylene sheet, so that these envelopes could be opened. After the adhesive warmed to room temperature the envelope could be re-closed and re-sealed without evidencing that the closures had been violated.

Having described preferred embodiments of the present invention, modifications and variations thereof falling within the spirit and scope of the invention may become apparent to those skilled in the art, and it is to be understood that the scope of the present invention is to be determined by the appended claims and their equivalents.

What is claimed is:

1. A tamper resistant envelope comprising a pair of thermoplastic panels defining a pocket therebetween and having an opening for inserting an item into the pocket, a pressure-sensitive adhesive positioned adjacent the opening on each said panel, said adhesive being heat-seal bonded directly to each respective panel, and wherein said adhesive on the respective panels is self-bonding when brought together to at least partially close the opening.

2. The envelope of claim 1 further including a removable release strip covering the adhesive on each panel to separate the adhesive on the respective panels and prevent closure prior to sealing of the envelope.

3. The envelope of claim 1, wherein one of said panels includes an extended portion that extends beyond said opening, said adhesive being heat-seal bonded to the inner surface of the extended portion of the one panel, and said adhesive being heat-seal bonded to an outer surface of the other panel, such that said extended portion can be folded to engage the adhesive of the respective panels to at least partially close the envelope.

4. The envelope of claim 1, wherein the adhesive extending along the opening on each of said panels is in the form of adhesive beads.

5. The envelope of claim 1 wherein each of said panels has an edge portion adjacent the opening in the same horizontal plane, said adhesive being heat-seal bonded to the edge portion of each panel within the pocket, such that said panels can be brought together to at least partially close the opening.

6. A tamper-resistant closure system for an envelope having two opposing panels which form a pocket therebetween and having an opening for inserting an item into the pocket, each of the panels having an edge portion adjacent the opening and formed of a thermoplastic resin, which system comprises two beads of a pressure-sensitive adhesive each extending along the opening and positioned on its corresponding edge portion so as to contact the opposing bead when the edge portions are brought together the adhesive of each bead being heat-seal bonded to the thermoplastic of the edge portion of a corresponding one of the panels and the beads being self-bonding to one another when brought together.

7. The closure system of claim 6, further including a removable release linear strip covering each of the beads of adhesive to separate the beads and prevent bonding therebetween prior to sealing of the envelope.

* * * * *